US011396777B1

(12) United States Patent
Xie et al.

(10) Patent No.: US 11,396,777 B1
(45) Date of Patent: Jul. 26, 2022

(54) ROTARY STEERING DRILLING APPARATUS

(71) Applicant: INSTITUTE OF GEOLOGY AND GEOPHYSICS, CHINESE ACADEMY OF SCIENCES, Beijing (CN)

(72) Inventors: Qijun Xie, Beijing (CN); Qingyun Di, Beijing (CN); Qingbo Liu, Beijing (CN); Yongyou Yang, Beijing (CN); Linfeng Hong, Beijing (CN); Xiangyang Wang, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 17/416,217

(22) PCT Filed: Mar. 22, 2021

(86) PCT No.: PCT/CN2021/081994
§ 371 (c)(1),
(2) Date: Jun. 18, 2021

(30) Foreign Application Priority Data

Feb. 8, 2021 (CN) ..... 202110172045.7

(51) Int. Cl.
*E21B 17/02* (2006.01)
*H01R 39/64* (2006.01)
*E21B 7/06* (2006.01)

(52) U.S. Cl.
CPC ..... *E21B 17/0285* (2020.05); *H01R 39/643* (2013.01); *E21B 7/06* (2013.01)

(58) Field of Classification Search
CPC ..... E21B 7/06; E21B 17/0285; H01R 39/64; H01R 39/643
See application file for complete search history.

(56) References Cited

U.S. PATENT DOCUMENTS 4,220,381 A 9/1980 Van der Graaf
6,189,621 B1 * 2/2001 Vail, III ..... E21B 23/01 166/241.5

(Continued)

FOREIGN PATENT DOCUMENTS

CN 101315022 A 12/2008
CN 102865038 A 1/2013

(Continued)

OTHER PUBLICATIONS

International Search Report (Form PCT/ISA/210); dated Feb. 8, 2021 in corresponding PCT Application No. PCT/CN2021/081994 (5 pages).

(Continued)

*Primary Examiner* — Shane Bomar
(74) *Attorney, Agent, or Firm* — Staas & Halsey LLP

(57) ABSTRACT

Disclosed is a rotary steering drilling apparatus. The rotary steering drilling apparatus includes a plurality of cylinders that are fixedly connected in series, wherein at least a part of adjacent cylinders are in power connection via a power connection unit; the power connection unit includes a first electrical connecting assembly and a second electrical connecting assembly, the cylinder in power connection is provided with a first electrical connecting assembly at one end and a second electrical connecting assembly at the other end, the adjacent cylinders are in power connection via the first electrical connecting assembly and the second electrical connecting assembly, and the first electrical connecting assembly and the second electrical connecting assembly on the same cylinder are in power connection; the first electrical connecting assembly includes a first electrical connecting ring which is arranged annularly, and the first electrical connecting ring includes a plurality of first conducting regions and first insulating regions which are distributed circumferentially and are spaced apart; and the second (Continued)

electrical connecting assembly includes a second electrical connecting ring which is arranged annularly, and the second electrical connecting ring includes a plurality of second conducting regions and second insulating regions which are spaced apart. The rotary steering drilling apparatus according to the present application can achieve multi-path power connection between adjacent cylinders and has the advantages of being convenient to mount, high in conductivity reliability and the like.

20 Claims, 6 Drawing Sheets

(56) References Cited

U.S. PATENT DOCUMENTS

| | | | | |
|---|---|---|---|---|
| 2010/0130027 | A1* | 5/2010 | Sihler | H01R 39/64<br>439/26 |
| 2013/0299237 | A1* | 11/2013 | Johnson | E21B 47/13<br>175/40 |
| 2014/0048285 | A1* | 2/2014 | Sihler | E21B 17/05<br>175/315 |
| 2017/0002613 | A1* | 1/2017 | Kirkhope | E21B 7/062 |
| 2017/0037685 | A1* | 2/2017 | Strachan | E21B 10/00 |
| 2018/0058200 | A1* | 3/2018 | Zheng | G01V 3/28 |
| 2021/0301646 | A1* | 9/2021 | He | F16F 15/08 |
| 2022/0090484 | A1* | 3/2022 | Moss | E21B 47/00 |

FOREIGN PATENT DOCUMENTS

| | | | |
|---|---|---|---|
| CN | 203626888 | U | 6/2014 |
| CN | 109779524 | A | 5/2019 |
| DE | 4037259 | A1 | 5/1992 |

OTHER PUBLICATIONS

Written Opinion of the ISA (Form PCT/ISA/237); dated Oct. 15, 2021 in corresponding PCT Application No. PCT/CN2021/081994 (4 pages) (5 pages English Translation).

* cited by examiner

ROTARY STEERING DRILLING APPARATUS

CROSS REFERENCE TO RELATED APPLICATIONS

This application is a U.S. National Stage Application under 35 U.S.C. § 371 of PCT International Patent Application No. PCT/CN2021/081994, filed on Mar. 22, 2021, which claims the foreign priority benefit under 35 U.S.C. § 119 of Chinese Patent Application No. 202110172045.7, filed on Feb. 8, 2021, in the China National Intellectual Property Administration, the contents of both of which International Patent Application and the Chinese Application are incorporated by reference herein in their entirety.

TECHNICAL FIELD

The present application belongs to the technical field of underground exploration, in particular to a rotary steering drilling apparatus.

BACKGROUND

Underground exploration technologies (for example, oil exploration technologies, shale gas exploration technologies and the like) play a critical role in development of national economical establishments. In a field exploration process, a rotary steering drilling apparatus is indispensable. A stretching end, stretching underground, of the rotary steering drilling apparatus includes various functional units. These functional units include a communication unit, a measuring unit, a steering executing unit and the like. It is of critical meaning in normal work of the rotary steering drilling apparatus and precise feedback of information by way of providing electric power to these units.

As the stretching end of the rotary steering drilling apparatus has multiple functions and the functional mechanisms are coated in a plurality of cylinders connected one another, how to achieve safe and reliable power connection among the cylinders is the technical problem which is extremely hard to overcome in the field. It should be noted that in a conventional method, power connection is achieved by power connection units through single channel power connection units. In the conventional method, power transmission and communication transmission share a same power channel. It is extremely easy for the transmission method to cause signal interference without a complex circuit design, so that the acquired information is not accurate enough, and the exploration performance of the rotary steering drilling apparatus is affected severely. Besides, electrical characteristics (for example, voltage and current) needed by different electrical units are different, and a conventional power supply mode only can supply one type of power.

In addition, as the cylinders are connected one another by way of threaded connection in most cases, the electrical connecting ring at the connection of the cylinders will generate a large frictional force as a needed torque is extremely large in a connecting process, so that the connection of the electrical connecting ring is stressed, and the conductive path is easily short-circuited or is short-circuited with the cylinders easily after the cylinders are disassembled and assembled for many times.

Thus, it is an urgent need of the rotary steering drilling apparatus which has the advantages of simple structure, formation of multiple conductive paths, high conducting reliability and the like.

It should be noted that the above content belongs to the technical cognition category of the inventors, and does not necessarily constitute the prior art.

SUMMARY

The present disclosure provides a rotary steering drilling apparatus to solve at least one of the technical problems.

The technical solution adopted by the present disclosure is as follows:

A rotary steering drilling apparatus includes a plurality of cylinders connected in series, wherein each of the cylinders is fixedly connected to the adjacent cylinders, at least part of the adjacent cylinders are in power connection via a power connection unit, and the power connection unit is insulated from the cylinders, the power connection unit includes a first electrical connecting assembly and a second electrical connecting assembly, the cylinder in power connection via the power connection unit is provided with a first electrical connecting assembly at one end and a second electrical connecting assembly at the other end, the adjacent cylinders are in multi-path power connection via the first electrical connecting assembly and the second electrical connecting assembly, and the first electrical connecting assembly and the second electrical connecting assembly on the same cylinder are in power connection;

the first electrical connecting assembly includes a first electrical connecting ring which is arranged annularly, and the first electrical connecting ring includes 2N+2 regions which are distributed circumferentially, wherein N is a positive integer greater than or equal to 1, a part of the regions are set as first conducting regions, the rest part of the regions are set as first insulating regions, and the first conducting regions and the first insulating regions are circumferentially spaced apart; and the second electrical connecting assembly includes a second electrical connecting ring which is arranged annularly, the second electrical connecting ring includes 2M+2 regions which are distributed circumferentially, wherein M is a positive integer greater than or equal to 1, a part of the regions are set as second conducting regions, the rest part of the regions are set as second insulating regions, and the second conducting regions and the second insulating regions are circumferentially spaced apart.

Preferably, the power connection unit further includes a transitional electrical connecting ring which is arranged annularly, the transitional electrical connecting ring includes a plurality of circumferentially spaced third conducting regions and third insulating regions, the transitional electrical connecting ring is arranged between the first electrical connecting ring and the second electrical connecting ring, the first electrical connecting ring and the transitional electrical connecting ring are in multi-path power connection via a plurality of conducting metal rolling bodies, and/or the second electrical connecting ring and the transitional electrical connecting ring are in multi-path power connection via a plurality of conducting metal rolling bodies, and the first electrical connecting ring and the second electrical connecting ring are in multi-path power connection via the transitional electrical connecting ring and the conducting metal rolling bodies; or the power connection unit further includes two transitional electrical connecting rings which are arranged annularly, each transitional electrical connecting ring includes a plurality of circumferentially spaced third conducting regions and third insulating regions, the two transitional electrical connecting rings are arranged between the first electrical connecting ring and the second electrical connecting ring, the first electrical connecting ring is in multi-path power connection to one side of one transitional electrical connecting ring which is oppositely adapted to the first electrical connecting ring, the second electrical connecting ring is in multi-path power connection to one side of the other transitional electrical connecting ring which is oppositely adapted to the second electrical connecting ring, the two transitional electrical connecting rings are in multi-path power connection via a plurality of conducting metal rolling bodies, and the first electrical connecting ring and the second electrical connecting ring are in multi-path power connection via the two transitional electrical connecting rings and the conducting metal rolling bodies.

In a structure where the first electrical connecting ring and the transitional electrical connecting ring are in multi-path power connection via a plurality of conducting metal rolling bodies, preferably, first limiting grooves adapted to the conducting metal rolling bodies are arranged on the first conducting regions or on the third conducting regions opposite to the first conducting regions, the metal rolling bodies are partially located in the first limiting grooves, and the first electrical connecting ring and the transitional electrical connecting ring are in multi-path power connection; and in a structure where the second electrical connecting ring and the transitional electrical connecting ring are in multi-path power connection via a plurality of conducting metal rolling bodies, preferably, second limiting grooves adapted to the conducting metal rolling bodies are arranged on the second conducting regions or on the third conducting regions opposite to the second conducting regions, the metal rolling bodies are partially located in the second limiting grooves, and the second electrical connecting ring and the transitional electrical connecting ring are in multi-path power connection.

In a structure where the first electrical connecting ring and the transitional electrical connecting ring are in multi-path power connection via a plurality of conducting metal rolling bodies, preferably, the central angles corresponding to the third conducting regions are larger than the central angles corresponding to the third insulating regions, the distance between contact positions of two adjacent conducting metal rolling bodies and the transitional electrical connecting ring is greater than the thickness of the third insulating region in a circumferential direction, and one of the first conducting regions is in power communication with the plurality of third conducting regions via the plurality of conducting metal rolling bodies; and in a structure where the second electrical connecting ring and the transitional electrical connecting ring are in multi-path power connection via a plurality of conducting metal rolling bodies, preferably, the central angles corresponding to the third conducting regions are larger than the central angles corresponding to the third insulating regions, the distance between contact positions of two adjacent conducting metal rolling bodies and the transitional electrical connecting ring is greater than the thickness of the third insulating region in a circumferential direction, and one of the second conducting regions is in power communication with the plurality of third conducting regions via the plurality of conducting metal rolling bodies.

Preferably, the first conducting regions and the first insulating regions on the first electrical connecting ring are set as fan-shaped circular ring structures and are uniformly distributed, and the central angles corresponding to the first conducting regions are larger than or equal to the central angles corresponding to the first insulating regions; and the second conducting regions and the second insulating regions on the second electrical connecting ring are set as fan-shaped circular ring structures and are uniformly distributed, and the central angles corresponding to the second conducting regions are larger than or equal to the central angles corresponding to the second insulating regions.

Preferably, the first electrical connecting ring includes two first conducting regions, and the second electrical connecting ring includes two second conducting regions; or the first electrical connecting ring includes two first conducting regions, and the second electrical connecting ring includes three second conducting regions; the central angles corresponding to the first conducting regions are larger than the central angles corresponding to the second insulating regions, the central angles corresponding to the first insulating regions are smaller than the central angles corresponding to the second conducting regions, and the sum of the central angles corresponding to the first conducting regions and the central angles corresponding to the second conducting regions is larger than 120 degrees but smaller than 180 degrees; or the first electrical connecting ring includes three first conducting regions, and the second electrical connecting ring includes three second conducting regions.

Preferably, at least two communication channels which enable the first electrical connecting ring to communicate with the second electrical connecting ring are arranged in the side wall of each cylinder, the first electrical connecting ring further includes first conductors, each of the first conducting regions on the first electrical connecting ring is in power connection to a first end of one of the first conductors, the second electrical connecting ring further includes second conductors, and each of the second conducting regions on the second electrical connecting ring is in power connection to a first end of one of the second conductors; and a second end of each of the first conductors and a second end of each of the second conductors respectively penetrate into the communication channels at set positions and are in power connection, and the first conductor and the second conductor are insulated from the side wall of the cylinder.

Preferably, an accommodation groove and a cover covering the accommodation groove are arranged on the side wall of the middle portion of each cylinder, the cover is detachably connected to the side wall of the cylinder, the accommodation groove is in communication with each of the communication channels via a through hole, the second end of each of the first conductors penetrates out of the through hole into the accommodation groove, and the second end of each of the second conductors penetrates out of the through hole into the accommodation groove is in power connection with the second end of the first conductor adapted to the second conductor.

Preferably, the second ends of a part of the first conductors are in power connection to the second ends of the second conductors adapted to the first conductors respectively via change-over switches.

Preferably, a first annular accommodation groove used for accommodating the first electrical connecting assembly is arranged on one end of at least part of the cylinders, and a second annular accommodation groove used for accommodating the second electrical connecting assembly is arranged on the other end of the cylinder, the first electrical connecting ring is adaptively connected to the first annular accommodation groove and is insulated from the cylinder, and the second electrical connecting ring and is insulated from the cylinder is adaptively connected to the second annular accommodation groove; and the adjacent cylinders are connected by a rotary buckle, such that the first electrical connecting assembly and the second electrical connecting assembly abut against each other; and the cylinder is made of a conducting material, and the adjacent cylinders can be conductive.

The rotary steering drilling apparatus provided by the present application has the beneficial effects that:

1. According to the present application, as the first electrical connecting ring includes a plurality of first conducting regions and first insulating regions which are distributed circumferentially and are arranged in a spaced manner and the second electrical connecting ring includes a plurality of second conducting regions and second insulating regions which are distributed circumferentially and are arranged in a spaced manner, and multi-path power connection between the cylinders is achieved by means of power connection between the first electrical connecting ring and the second electrical connecting ring, the demand on multi-path power supply of the rotary steering drilling apparatus is further met effectively, and meanwhile, the communication line and the power supply line are mutually isolated to prevent information transferred by the communication line from being intervened by the power supply line, such that obtained feedback information is more precise.

2. According to the present application, the power connection unit includes the annularly arranged transitional electrical connecting ring, so that the transitional electrical connecting ring and the first electrical connecting ring, and the second electrical connecting ring and the transitional electrical connecting ring or at least one of the two transitional electrical connecting rings between the first electrical connecting ring and the second electrical connecting ring are in multi-path power connection via the conducting metal rolling bodies. In an assembling process of the cylinders, sliding friction is formed between the first electrical connecting ring and the second electrical connecting ring to improve the stress condition of the power connection unit when the cylinders are connected. Even if the cylinders are disassembled and assembled for many times, the reliability of power connection between the cylinders can be guaranteed, so that problems of short circuit, open circuit and the like induced by sliding friction can be avoided effectively.

3. According to the present application, the quantities of the first conducting regions on the first electrical connecting ring and the second conducting regions on the second electrical connecting ring may be set selectively according to the quantity of the power channels among the needed cylinders, so that, preferably, one of the first electrical connecting ring and the second electrical connecting ring is provided with two conducting regions, the other is provided with three conducting regions, the sizes of the central angles corresponding to the first and second conducting regions are further defined, so that two adjacent cylinders can form two power channels regardless of being locked in any position; on a basis of ensuring the reliability of multi-path power connection, the process demand and the assembling difficulty of connection between two cylinders are reduced effectively, and meanwhile, the mounting efficiency of the rotary steering drilling apparatus is improved effectively.

4. According to the present application, as the accommodation groove for enabling the first conductor to communicate with the second conductor is formed in the side wall of the cylinder, power connection between the first conductor and the second conductor adapted to the first conductor is facilitated. In order to further ensure that the current directions of the electrical unit is kept consistent quickly before and after disassembling the cylinder, the first and second conductors are connected by the change-over switch, and change-over of the power supply direction is realized by the change-over switch.

BRIEF DESCRIPTION OF THE DRAWINGS

The drawings described herein are used to provide a further understanding of the present application and form a part of the present application. The schematic embodiments and descriptions of the present application are used to explain the present application and do not constitute an undue limitation on the present application. In the drawings.

In the drawings.

Figure 1:
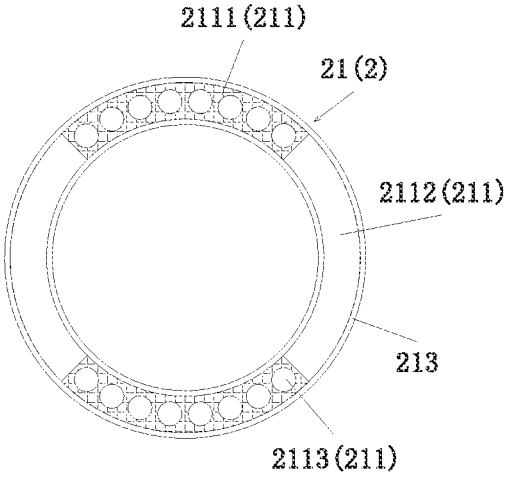
FIG. 1 is a front view of a first electrical connecting assembly included in a rotary steering drilling apparatus provided by the embodiment of the present application.

1 cylinder, 11 communication channel, 12 through hole,

2 power connection unit, 21 first electrical connecting assembly, 211 first electrical connecting ring, 2111 first conducting region, 2112 first insulating region, 2113 first limiting groove, 212 first conductor, 213 first insulator, 22 second electrical connecting assembly. 221 second electrical connecting ring, 2211 second conducting region, 2212 second insulating region, 2213 second limiting groove, 223 second conductor, 224 second insulator, 23 transitional electrical connecting ring, 231 third conducting region, 232 third insulating region,

3 conducting metal rolling body,

4 accommodation groove,

5 cover.

DETAILED DESCRIPTION

To explain the overall conception of the present application more clearly, detailed description is conducted below with reference to the accompanying drawings of the description in the form of examples.

In description of the present application, it should be understood that orientation or position relationships indicated by terms: 'central', 'upper, 'lower, 'front', 'back', 'left', 'right', 'vertical', 'horizontal', 'top', 'bottom', 'inner'. 'outer', 'axial', 'radial', 'circumferential' and the like are orientation or position relationships indicated by the drawings and are only to describe the present application and simplify, the description rather than indicate or imply that the indicated device or components must have specific orientations and are configured and operated in the specific orientations. Therefore, it cannot be construed as limitations to the present application.

In addition, terms 'first' and 'second' are only used for a description purpose rather than being construed to indicate or imply relative importance or implicitly indicate the quantity of indicated technical features. Thus, the feature defined by "first" and "second" can explicitly or implicitly include one or more features. In the description of the present application, "a plurality of" means two or more, unless otherwise specifically defined.

In the present application, unless otherwise specified and limited, the terms "mounting", "connected", "connection", "fixation" and the like should be understood in a broad sense, for example, it may be fixed connection, and may also be detachable connection, or integrated connection; it may be mechanical connection, may be electric connection and may also be communication; and it may be direction connection, may be indirect connection through an intermediate medium, and may be internal communication of two components or interaction relationship between two components. A person of ordinary skill in the art may understand specific meanings of the above-mentioned terms in the present application based on the specific situation.

In the present application, unless otherwise specified and limited, the first feature "above" or "below" the second feature may be direct contact of the first feature and the second feature, or indirect contact of the first feature and the second feature through the intermediate medium. In the description, specific features, structures, materials or characteristics described can be combined in any one or more solutions or examples in a proper manner.

In the present application, more than a certain numerical value includes primitive number, for example, more than two includes two.

A rotary steering drilling apparatus shown in FIG. 1 to FIG. 13 includes a plurality of cylinders 1 that are fixedly connected in series. Each of the cylinders 1 is fixedly connected to the adjacent cylinders 1. At least part of the adjacent cylinders 1 are in power connection via a power connection unit 2. The power connection unit 2 is insulated from the cylinders 1. The power connection unit 2 includes a first electrical connecting assembly 21 and a second electrical connecting assembly 22, the cylinder 1 in power connection via the power connection unit 2 is provided with a first electrical connecting assembly 21 at one end and a second electrical connecting assembly 22 at the other end, the adjacent cylinders 1 are in multi-path power connection via the first electrical connecting assembly 21 and the second electrical connecting assembly 22, and the first electrical connecting assembly 21 and the second electrical connecting assembly 22 on the same cylinder 1 are in power connection; the first electrical connecting assembly 21 includes a first electrical connecting ring 211 that is annularly arranged, and the first electrical connecting ring 211 includes 2N+2 regions that are circumferentially distributed, wherein N is a positive integer greater than or equal to 1, a part of the regions are set as first conducting regions 2111, the rest part of the regions are set as first insulating regions 2112, and the first conducting regions 2111 and the first insulating regions 2112 are circumferentially spaced apart; and the second electrical connecting assembly 22 includes a second electrical connecting ring 221 that is annularly arranged, and the first electrical connecting ring 221 includes 2M+2 regions that are circumferentially distributed, wherein M is a positive integer greater than or equal to 1, a part of the regions are set as second conducting regions 2211, the rest part of the regions are set as second insulating regions 2212, and the second conducting regions 2211 and the second insulating regions 2212 are circumferentially spaced apart. It should be noted that the cylinders are parts forming the underground stretching end of the rotary steering drilling apparatus. In specific implementation, N may be selectively set as a positive integer such as 1, 2, 3, 4, 5 or 6 or above, and similarly, M may be further selectively set as a positive integer such as 1, 2, 3, 4, 5 or 6 or above; and the first electrical connecting assembly 21 and the second electrical connecting assembly 22 may be the electrical connecting assemblies of same structures or different structures.

In addition, according to the present application, the first electrical connecting assembly 21 and the second electrical connecting assembly 22 form two or more power communication channels selectively according to an actual need. Further, preferably, the cylinders are made of a conducting material, and adjacent cylinders can be conductive to be used as a part of a conductive circuit after being connected. According to the present application, as the first electrical connecting ring 211 includes a plurality of first conducting regions 2111 and first insulating regions 2112 which are distributed circumferentially and are spaced apart, and the second electrical connecting ring 221 includes a plurality of second conducting regions 2211 and second insulating regions 2212 which are distributed circumferentially and are spaced apart, and multi-path (at least two-path) power connection between the cylinders is achieved by means of power connection between the first electrical connecting ring 211 and the second electrical connecting ring 221, the demand on multi-path power supply of the rotary steering drilling apparatus is further met effectively, and meanwhile, the communication line and the power supply line are mutually isolated to prevent information transferred by the communication line from being intervened by the power supply line, thereby providing extremely precise information feedback to exploration work. As a convertible embodiment, in specific implementation, according to the present application, the quantity of the first conducting regions 2111 on the first electrical connecting ring 211 is selectively equal to that of the second conducting regions 2211 on the second electrical connecting ring 221, or the quantity of the first conducting regions 2111 on the first electrical connecting ring 211 is selectively smaller than that of the second conducting regions 2211 on the second electrical connecting ring 221.

Figure 4:
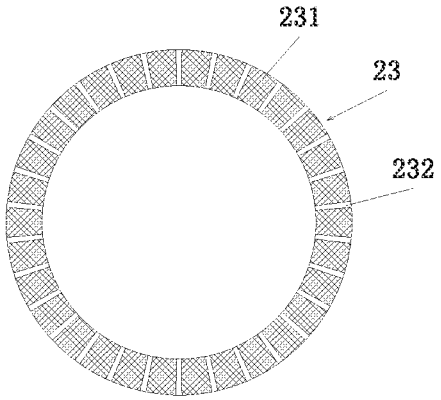
FIG. 4 is a structural schematic diagram of a transitional electrical connecting ring included in the rotary steering drilling apparatus provided by the embodiment of the present application.
Figure 8:
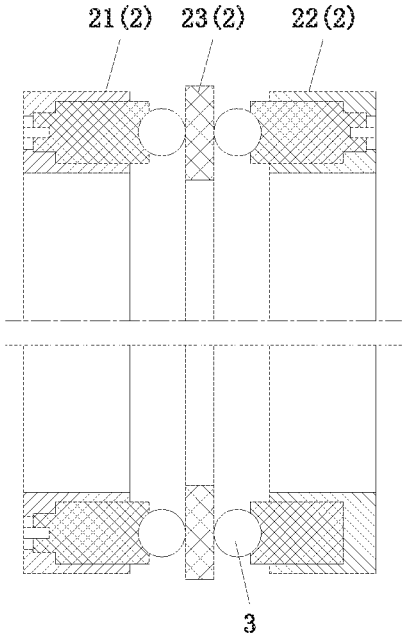
FIG. 8 is a structural schematic diagram of a power connecting unit formed by the first electrical connecting assembly, the second electrical connecting assembly and the transitional electrical connecting ring provided by the embodiment of the present application.
Figure 9:
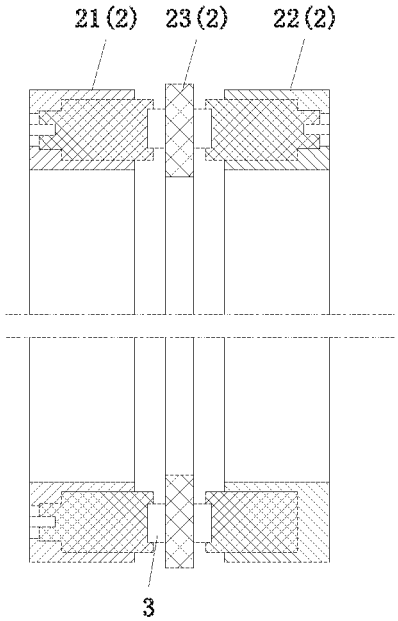
FIG. 9 is a structural schematic diagram of another power connecting unit formed by the first electrical connecting assembly, the second electrical connecting assembly and the transitional electrical connecting ring provided by the embodiment of the present application.
Figure 10:
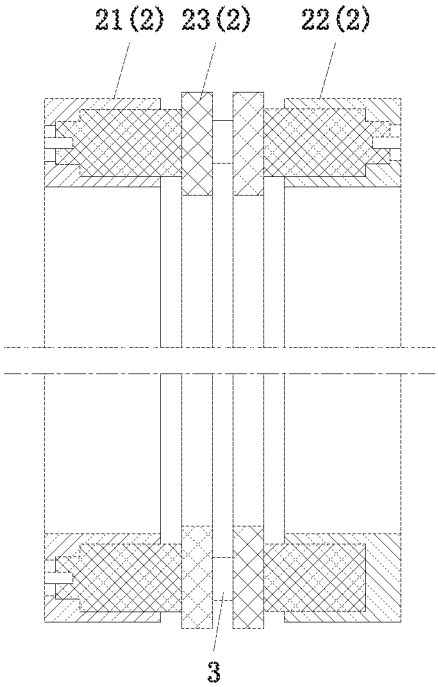
FIG. 10 is a structural schematic diagram of a third power connecting unit formed by the first electrical connecting assembly, the second electrical connecting assembly and the transitional electrical connecting ring provided by the embodiment of the present application.

As a preferred implementation of the present application, according to the present application, selectively, the power connection unit 2 further includes a transitional electrical connecting ring 23 which is annularly arranged (as shown in FIG. 4), the transitional electrical connecting ring 23 includes a plurality of third conducting regions 231 and third insulating regions 232 which are circumferentially spaced apart, the transitional electrical connecting ring 23 is arranged between the first electrical connecting ring 211 and the second electrical connecting ring 221, as shown in FIG. 8 or FIG. 9, the first electrical connecting ring 211 and the transitional electrical connecting ring 23 are in multi-path power connection via a plurality of conducting metal rolling bodies 3 and/or the second electrical connecting ring 221 and the transitional electrical connecting ring 23 are in multi-path power connection via a plurality of conducting metal rolling bodies 3, and the first electrical connecting ring 211 and the second electrical connecting ring 221 are in multi-path power connection via the transitional electrical connecting ring 23 and the conducting metal rolling bodies 3. As a convertible implementation, according to the present application, the conducting metal rolling bodies 3 are selectively only arranged between the first electrical connecting ring 211 and the transitional electrical connecting ring 23 or only arranged between the second electrical connecting ring 221 and the transitional electrical connecting ring 23. In addition, in specific implementation, as shown in FIG. 10, the first electrical connecting ring 211 is in power connection to the second electrical connecting ring 221 selectively via two transitional electrical connecting rings 23. The two transitional electrical connecting rings 23 are arranged between the first electrical connecting ring 211 and the second electrical connecting ring 221, the first electrical connecting ring 211 is in multi-path power connection to one side of one transitional electrical connecting ring 23 which is oppositely adaptive to the first electrical connecting ring 211, the second electrical connecting ring 221 is in multi-path power connection to one side of the other transitional electrical connecting ring 23 which is oppositely adaptive to the second electrical connecting ring 221, the two transitional electrical connecting rings 23 are in multi-path power connection via a plurality of conducting metal rolling bodies 3. It should be noted that in specific implementation, preferably, the central angles corresponding to the third conducting regions 231 are smaller than the central angles corresponding to the first conducting regions 2111 and the central angles corresponding to the second conducting regions 2211. The conducting metal rolling bodies 3 are not defined specifically and may be any conducting rolling bodies which make the first electrical connecting assembly 21 and the second electrical connecting assembly 22 form rolling friction in a connecting process, for example, the conducting metal rolling bodies 3 are selectively set as spherical rolling bodies (as shown in FIG. 8), columnar rolling bodies (as shown in FIG. 9) and the like.

In specific implementation, preferably, the transitional electrical connecting ring 23 is set as a circular ring structure formed by arranging the plurality of third conducting regions 231 and the plurality of third insulating regions 232 in a spaced manner, the central angles corresponding to the third conducting regions 231 are larger than the central angles corresponding to the third insulating regions 232, and further, preferably, the thickness of the third insulating region 232 in the circumferential direction is reduced as far as possible under a condition that the third insulating region 232 isolates two adjacent third conducting regions 231 is met, such that the transitional electrical connecting property of the transitional electrical connecting ring 23 is improved. According to the present application, the power connection unit 2 includes the transitional electrical connecting ring 23 which is annularly arranged, so that the transitional electrical connecting ring 23 and the first electrical connecting ring 211, and the second electrical connecting ring 221 and the transitional electrical connecting ring 23 or at least one of the two transitional electrical connecting rings 23 between the first electrical connecting ring 211 and the second electrical connecting ring 221 are in multi-path power connection via the conducting metal rolling bodies 3, further in an assembling process of the cylinders, sliding friction is formed between the first electrical connecting assembly 21 and the second electrical connecting assembly 22 to avoid circumferential forces to the first electrical connecting ring 211 and the second electrical connecting ring 221 in a connecting process so as to improve the stress condition of the power connection unit 2 when the cylinders are connected. Meanwhile, a problem that electrical contacts between the first electrical connecting ring 211 and the second electrical connecting ring 221 and conducting leads in power connection to the first electrical connecting ring 211 and the second electrical connecting ring 221 are damaged in the assembling process can be avoided. Even if the cylinders are disassembled and assembled for many times, the reliability of power connection between the cylinders can be guaranteed, so that problems of short circuit, open circuit and the like induced by sliding friction can be avoided effectively.

As a preferred embodiment in this implementation, in a structure where the first electrical connecting ring 211 and the transitional electrical connecting ring 23 are in multi-path power connection via a plurality of conducting metal rolling bodies 3, first limiting grooves 2113 adapted to the conducting metal rolling bodies 3 are arranged on the first conducting regions 2111, and the metal rolling bodies 3 are partially located in the first limiting grooves 2113 and enable the first electrical connecting ring 211 and the transitional electrical connecting ring 23 to be in multi-path power connection; and as a convertible embodiment, the first limiting grooves 2113 adapted to the conducting metal rolling bodies 3 are arranged in the third conducting regions 231 arranged opposite to the first conducting regions 2111 selectively, the metal rolling bodies 3 are partially located in the first limiting grooves 2113 and enable the first electrical connecting ring 211 and the transitional electrical connecting ring 23 to be in multi-path power connection. In specific implementation, further preferably, the central angles corresponding to the third conducting regions 231 are larger than the central angles corresponding to the third insulating regions 232, the distance between contact positions of two adjacent conducting metal rolling bodies 3 and the transitional electrical connecting ring 23 are greater than the thickness of the third insulating region 232 in a circumferential direction but smaller than a circumferential length between two circumferential ends of two adjacent third conducting regions 231, and one of the first conducting regions 2111 is in power communication with the plurality of third conducting regions 231 via the plurality of conducting metal rolling bodies 3.

As a preferred embodiment in this implementation, in a structure where the second electrical connecting ring 221 and the transitional electrical connecting ring 23 are in multi-path power connection via a plurality of conducting metal rolling bodies 3, second limiting grooves 2213 adapted to the conducting metal rolling bodies 3 are arranged on the second conducting regions 2211, and the metal rolling bodies 3 are partially located in the second limiting grooves 2213 and enable the second electrical connecting ring 221 and the transitional electrical connecting ring 23 to be in multi-path power connection; and as a convertible embodiment, second limiting grooves 2213 adapted to the conducting metal rolling bodies 3 are arranged in the third conducting regions 231 arranged opposite to the second conducting regions 2211 selectively, the metal rolling bodies 3 are partially located in the second limiting grooves 2213 and enable the second electrical connecting ring 221 and the transitional electrical connecting ring 23 to be in multi-path power connection. In specific implementation, further preferably, the central angles corresponding to the third conducting regions 231 are larger than the central angles corresponding to the third insulating regions 232, the distance between contact positions of two adjacent conducting metal rolling bodies 3 and the transitional electrical connecting ring 23 are greater than the thickness of the third insulating region 232 in a circumferential direction but smaller than a circumferential length between two circumferential ends of two adjacent third conducting regions 231, and one of the second conducting regions 2211 is in power communication with the plurality of third conducting regions 231 via the plurality of conducting metal rolling bodies 3. It should be noted that the structural shapes of the first limiting grooves 2113 and the second limiting grooves 2213 are not defined specifically. Specifically, the structural shapes can be selectively adapted according to the structural forms of the conducting metal rolling bodies 3 adapted to the first limiting grooves 2113 and the second limiting grooves 2213. In particular, when the conducting metal rolling bodies 3 are set as special structures, the limiting grooves are set as grooves adapted to the spherical structures. Further, for example, when the conducting metal rolling bodies 3 are set as cylindrical structures, the limiting grooves are set as grooves adapted to the cylindrical structures.

As a preferred implementation of the present application, according to the present application, further selectively, the first conducting regions 2111 and the first insulating regions 2112 on the first electrical connecting ring 211 are of fan-shaped circular ring structures and are uniformly distributed, and the central angles corresponding to the first conducting regions 2111 are equal to the central angles corresponding to the first insulating regions 2112; and the second conducting regions 2211 and the second insulating regions 2212 on the second electrical connecting ring 221 are of fan-shaped circular ring structures and are uniformly distributed, and the central angles corresponding to the second conducting regions 2211 are equal to the central angles corresponding to the second insulating regions 2212. It should be noted that the central angles corresponding to the conducting regions (the first conducting regions 2111 or the second conducting regions 2211) being equal to the central angles corresponding to the insulating regions (the first insulating regions 2112 or the second insulating regions 2212) does not represent that the central angles corresponding to the conducting regions (the first conducting regions 2111 or the second conducting regions 2211) and the central angles corresponding to the insulating regions (the first insulating regions 2112 or the second insulating regions 2212) are completely the same, and further includes differences caused by processing errors in a processing course. As a convertible implementation, in order to improve the electrical connecting property of the first electrical connecting assembly 21 and the second electrical connecting assembly 22, selectively, the central angles corresponding to the first conducting regions 2111 are larger than the central angles corresponding to the first insulating regions 2112, and the central angles corresponding to the second conducting regions 2211 are larger than the central angles corresponding to the second insulating regions 2212.

As a preferred embodiment in the above-mentioned implementation, further selectively, the first electrical connecting ring 211 includes two first conducting regions 2111, and the second electrical connecting ring 221 includes three second conducting regions 2211; in specific implementation, the central angles corresponding to the first conducting regions 2111 are larger than the central angles corresponding to the second insulating regions 2212, the central angles corresponding to the first insulating regions 2112 are smaller than the central angles corresponding to the second conducting regions 2211, and the sum of the central angles corresponding to the first conducting regions 2111 and the central angles corresponding to the second conducting regions 2211 is larger than 120 degrees but smaller than 180 degrees. In this way, two adjacent cylinders can form two power channels regardless of being locked in any position; on a basis of ensuring the reliability of multi-path power connection, the process demand and the assembling difficulty of connection between two cylinders are reduced effectively, and meanwhile, the mounting efficiency of the rotary steering drilling apparatus is improved effectively.

As a convertible embodiment, according to the present application, preferably, the first electrical connecting ring 211 includes two first conducting regions 2111, and the second electrical connecting ring 221 includes two second conducting regions 2211; or, selectively, the first electrical connecting ring 211 includes three first conducting regions 2111, and the second electrical connecting ring 221 includes three second conducting regions 2211. It should be noted that in specific implementation, the quantity of the first conducting regions 2111 on the first electrical connecting ring 211 and the quantity of the second conducting regions 2211 on the second electrical connecting ring 221 can be set selectively according to an actual demand to meet different power supply and communication demands.

Figure 11:
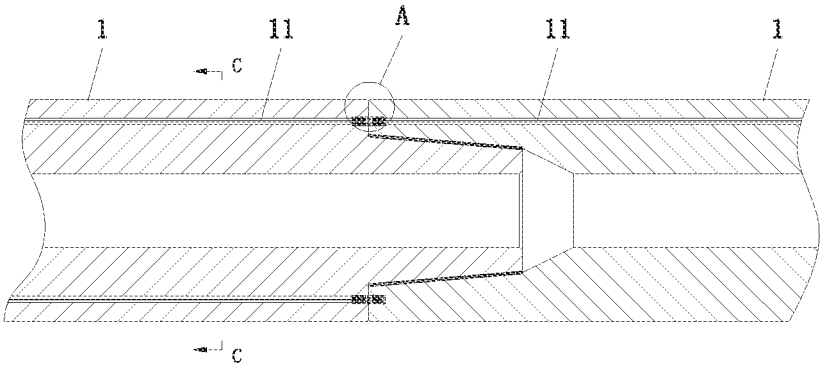
FIG. 11 is a structural schematic diagram of connection between the cylinders of the rotary steering drilling apparatus provided by the embodiment of the present application.
Figure 12:
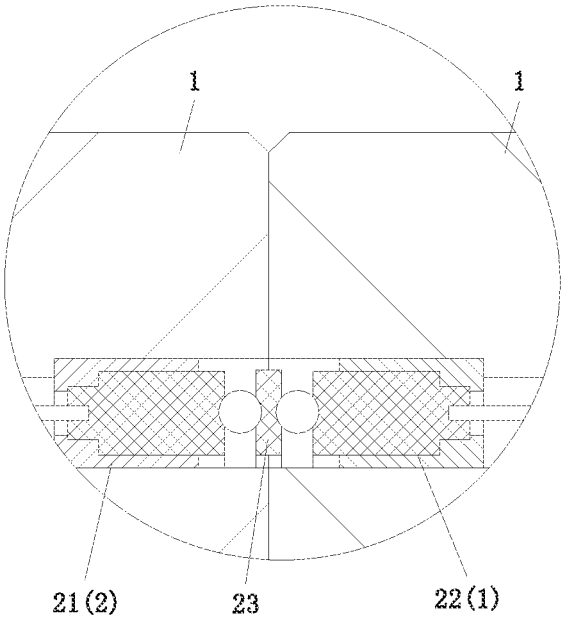
FIG. 12 is a partial enlarged view of a structure at A of FIG. 11.

As a preferred implementation of the present application, as shown in FIG. 11 and FIG. 12, according to the above-mentioned all implementations, embodiments and convertible implementations and convertible embodiments thereof, further selectively, at least two communication channels 11 for enabling the first electrical connecting ring 211 to communicate the second electrical connecting ring 221 are arranged in the side wall of each cylinder 1; the first electrical connecting assembly 21 further includes first conductors 212, each of the first conducting regions 2111 on the first electrical connecting ring 211 is in power connection to a first end of one of the first conductors 212, the second electrical connecting assembly 22 further includes second conductors 223, each of the second conducting regions 2211 on the second electrical connecting assembly 22 is in power connection to a first end of one of the second conductors 223; a second end of each first conductor 212 and a second end of each second conductor 223 respectively penetrate into the communication channels 11 at set positions and are in power connection, and the first conductor 212 and the second conductor 223 are insulated from the side wall of the cylinder 1.

Figure 13:
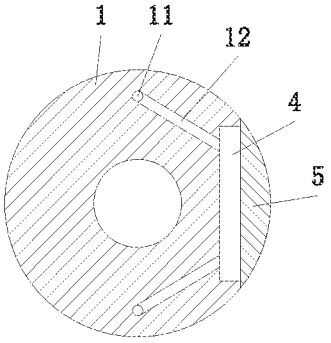
FIG. 13 is a C-C section view of FIG. 11.

As a preferred embodiment in the above-mentioned implementation, as shown in FIG. 13, further preferably, an accommodation groove 4 and a cover 5 covering the accommodation groove 4 are arranged in a side wall of a middle portion of each cylinder 1, the cover 5 is detachably connected to the side wall of the cylinder 1, the accommodation groove 4 communicates with each communication channel 11 via a through hole 12, the second end of each first conductor 212 penetrates out of the through hole 12 into the accommodation groove 4, and the second end of each second conductor 223 penetrates out of the through hole 12 into the accommodation groove 4 and is in power connection to the second end of the first conductor 212 adapted to the second conductor 223. According to the present application, the accommodation groove 4 for enabling the first conductor 212 to communicate with the second conductor 223 is formed in the side wall of the cylinder 1, such that the first conductor 212 is in power connection to the second conductor 223 adapted to the first conductor 212. In order to make sure normal work of the electrical unit after the cylinders 1 included in the rotary steering drilling apparatus are disassembled and assembled for many times, in specific implementation, further preferably, the second ends of at least part of the first conductors 212 are in power connection to the second ends of the second conductors 223 adapted to the first conductors via change-over switches. Further preferably, the second ends of all the first conductors 212 are in power connection to the second ends of the second conductors 223 adapted to the first conductors via change-over switches.

Figure 2:
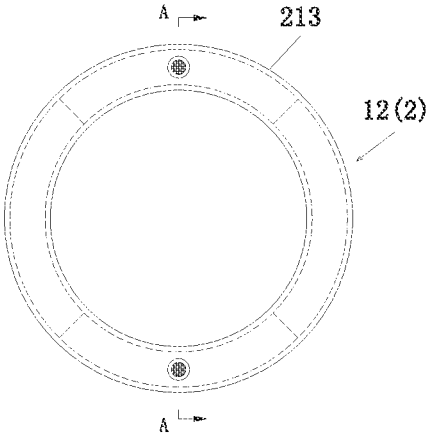
FIG. 2 is a rear view of the first electrical connecting assembly included in the rotary steering drilling apparatus provided by the embodiment of the present application.
Figure 3:
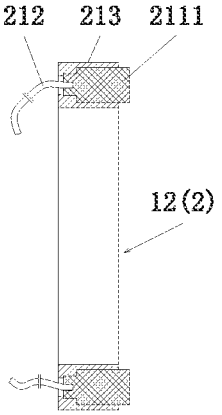
FIG. 3 is an A-A section view of FIG. 2.
Figure 5:
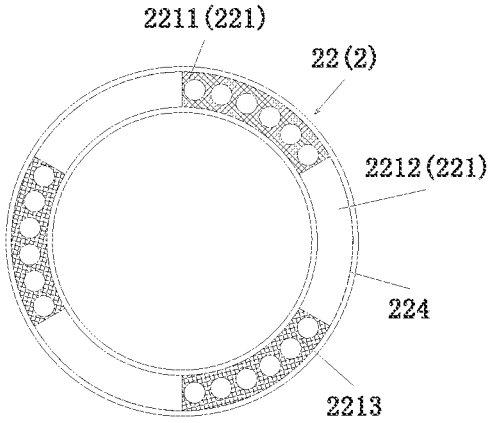
FIG. 5 is a front view of a second electrical connecting assembly included in the rotary steering drilling apparatus provided by the embodiment of the present application.
Figure 6:
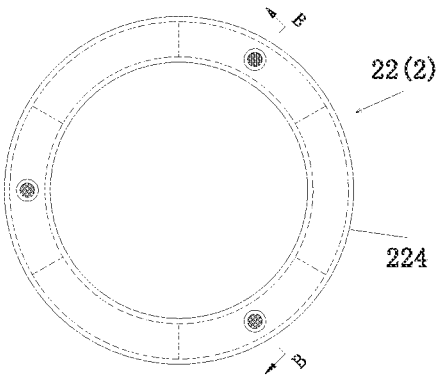
FIG. 6 is a rear view of the second electrical connecting assembly included in the rotary steering drilling apparatus provided by the embodiment of the present application.
Figure 7:
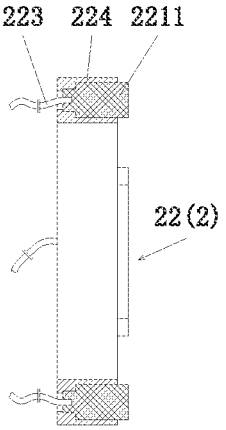
FIG. 7 is a B-B section view of FIG. 6.

In specific implementation, according to the rotary steering drilling apparatus provided by the present application, a first annular accommodation groove for accommodating the first electrical connecting assembly 21 is formed in one end of the cylinder 1, and a second annular accommodation groove for accommodating the second electrical connecting assembly 22 is formed in the other end of the cylinder, the first electrical connecting ring 211 is adaptively connected to the first annular accommodation groove and is insulated from the cylinder 1, and the second electrical connecting ring 221 is adaptively connected to the second annular accommodation groove and is insulated from the cylinder 1; and further preferably, the adjacent cylinders 1 are connected by a rotary buckle, such that the first electrical connecting assembly 21 and the second electrical connecting assembly 22 abut against each other. In specific implementation, further preferably, the first electrical connecting assembly 21 further includes a first insulator 213, and is sleeved with the first annular accommodation groove via the first insulator 213; the second electrical connecting assembly 22 further includes a second insulator 224 and is sleeved with the second annular accommodation groove via the second insulator 213; in specific implementation, preferably, the first insulator 213 is set as an annular-groove-shaped structure (as shown in FIG. 1 to FIG. 3), and the second insulator 224 is set as an annular-groove-shaped structure (as shown in FIG. 5 to FIG. 7).

It should be noted that 'multi-path power connection' in the present application means a power connection form in which at least two conducting channels are formed. In addition, in specific implementation, selectively, the transitional electrical connecting ring 23 is fixedly arranged between the first electrical connecting assembly 21 and the second electrical connecting assembly 22 via a fixing rack made of an insulating material.

Embodiments in the description are described in a progressive manner. The same and similar parts among the embodiments are referenced to each other. Each embodiment focuses on the differences from other embodiments. In particular, for the system embodiment which is basically similar to the method embodiment, the description is relatively simple, and the relevant points are referenced to the partial description of the method embodiment.

The above is only an embodiment of the present application and is not intended to limit the present application. For the central angles skilled in the art, the application may have various modifications and changes. Any modifications, equivalent substitutions, improvements, etc. made within the spirit and principle of the present application should be included within the scope of the claims of the present application.

The invention claimed is:

1. A rotary steering drilling apparatus, comprising:

a plurality of cylinders connected in series, wherein each of the cylinders is fixedly connected to the adjacent cylinders, at least part of the adjacent cylinders are in power connection via a power connection unit, and the power connection unit is insulated from the cylinders;

the power connection unit comprises a first electrical connecting assembly and a second electrical connecting assembly, the cylinder in power connection via the power connection unit is provided with a first electrical connecting assembly at one end and a second electrical connecting assembly at the other end, the adjacent cylinders are in multi-path power connection via the first electrical connecting assembly and the second electrical connecting assembly, and the first electrical connecting assembly and the second electrical connecting assembly on the same cylinder are in power connection;

the first electrical connecting assembly comprises a first electrical connecting ring which is arranged annularly, and the first electrical connecting ring comprises 2N+2 regions which are distributed circumferentially, wherein N is a positive integer greater than or equal to 1, a part of the regions are set as first conducting regions, the rest part of the regions are set as first insulating regions, and the first conducting regions and the first insulating regions are circumferentially spaced apart; and the second electrical connecting assembly comprises a second electrical connecting ring which is arranged annularly, the second electrical connecting ring comprises 2M+2 regions which are distributed circumferentially, wherein M is a positive integer greater than or equal to 1, a part of the regions are set as second conducting regions, the rest part of the regions are set as second insulating regions, and the second conducting regions and the second insulating regions are circumferentially spaced apart.

2. The rotary steering drilling apparatus according to claim 1, wherein the power connection unit further comprises a transitional electrical connecting ring which is arranged annularly, the transitional electrical connecting ring comprises a plurality of circumferentially spaced third conducting regions and third insulating regions, the transitional electrical connecting ring is arranged between the first electrical connecting ring and the second electrical connecting ring, the first electrical connecting ring and the transitional electrical connecting ring are in multi-path power connection via a plurality of conducting metal rolling bodies, and/or the second electrical connecting ring and the transitional electrical connecting ring are in multi-path power connection via a plurality of conducting metal rolling bodies, and the first electrical connecting ring and the second electrical connecting ring are in multi-path power connection via the transitional electrical connecting ring and the conducting metal rolling bodies; or the power connection unit further comprises a transitional electrical connecting ring which is arranged annularly, the transitional electrical connecting ring comprises a plurality of circumferentially spaced third conducting regions and third insulating regions, the two transitional electrical connecting rings are arranged between the first electrical connecting ring and the second electrical connecting ring, the first electrical connecting ring is in multi-path power connection to one side of one transitional electrical connecting ring which is oppositely adapted to the first electrical connecting ring, the second electrical connecting ring is in multi-path power connection to one side of the other transitional electrical connecting ring which is oppositely adapted to the second electrical connecting ring, the two transitional electrical connecting rings are in multi-path power connection via conducting metal rolling bodies, and the first electrical connecting ring and the second electrical connecting ring are in multi-path power connection via the two transitional electrical connecting rings and the conducting metal rolling bodies.

3. The rotary steering drilling apparatus according to claim 2, wherein in a structure where the first electrical connecting ring and the transitional electrical connecting ring are in multi-path power connection via a plurality of conducting metal rolling bodies, a first limiting groove adapted to the conducting metal rolling bodies is arranged on the first conducting region or on the third conducting region opposite to the first conducting region, and the metal rolling bodies are partially located in the first limiting groove and enable the first electrical connecting ring to be in multi-path power connection to the transitional electrical connecting ring; and in a structure where the second electrical connecting ring and the transitional electrical connecting ring are in multi-path power connection via a plurality of conducting metal rolling bodies, a second limiting groove adapted to the conducting metal rolling bodies is arranged on the second conducting region or on the third conducting region opposite to the second conducting region, the metal rolling bodies are partially located in the second limiting groove and enable the second electrical connecting ring to be in multi-path power connection with the transitional electrical connecting ring.

4. The rotary steering drilling apparatus according to claim 2, wherein in a structure where the first electrical connecting ring and the transitional electrical connecting ring are in multi-path power connection via a plurality of conducting metal rolling bodies, a central angle corresponding to the third conducting region is larger than a central angle corresponding to the third insulating region, a distance between contact positions of two adjacent conducting metal rolling bodies and the transitional electrical connecting ring is greater than a thickness of the third insulating region in a circumferential direction, and one of the first conducting regions is in power communication with the plurality of third conducting regions via the plurality of conducting metal rolling bodies; and in a structure where the second electrical connecting ring and the transitional electrical connecting ring are in multi-path power connection via a plurality of conducting metal rolling bodies, a central angle corresponding to the third conducting region is larger than a central angle corresponding to the third insulating region, a distance between contact positions of two adjacent conducting metal rolling bodies and the transitional electrical connecting ring is greater than a thickness of the third insulating region in a circumferential direction, and one of the second conducting regions is in power communication with the plurality of third conducting regions via the plurality of conducting metal rolling bodies.

5. The rotary steering drilling apparatus according to claim 4, wherein the first conducting regions and the first insulating regions on the first electrical connecting ring are set as fan-shaped circular ring structures and are uniformly distributed, and a central angle corresponding to the first conducting region is larger than or equal to a central angle corresponding to the first insulating region; and the second conducting regions and the second insulating regions on the second electrical connecting ring are set as fan-shaped circular ring structures and are uniformly distributed, and a central angle corresponding to the second conducting region is larger than or equal to a central angle corresponding to the second insulating region.

6. The rotary steering drilling apparatus according to claim 5, wherein the first electrical connecting ring comprises two first conducting regions, and the second electrical connecting ring comprises two second conducting regions; or the first electrical connecting ring comprises two first conducting regions, and the second electrical connecting ring comprises three second conducting regions; a central angle corresponding to the first conducting region is larger than a central angles corresponding to the second insulating region, a central angle corresponding to the first insulating region is smaller than a central angle corresponding to the second conducting region, and the sum of the central angle corresponding to the first conducting region and the central angle corresponding to the second conducting region is larger than 120 degrees but smaller than 180 degrees; or the first electrical connecting ring comprises three first conducting regions, and the second electrical connecting ring comprises three second conducting regions.

7. The rotary steering drilling apparatus according to claim 1, wherein at least two communication channels for enabling the first electrical connecting ring to communicate with the second electrical connecting ring are arranged in a side wall of each cylinder, the first electrical connecting ring further comprises first conductors, each of the first conducting regions on the first electrical connecting ring is in power connection to a first end of one of the first conductors, the second electrical connecting ring further comprises second conductors, and each of the second conducting regions on the second electrical connecting ring is in power connection to a first end of one of the second conductors; and a second end of each of the first conductors and a second end of each of the second conductors respectively penetrate into the communication channels at set positions and are in power connection, and the first conductor and the second conductor are insulated from the side wall of the cylinder.

8. The rotary steering drilling apparatus according to claim 7, wherein an accommodation groove and a cover covering the accommodation groove are arranged in the side wall of the middle portion of each cylinder, the cover is detachably connected to the side wall of the cylinder, the accommodation groove is in communication with each of the communication channels via a through hole, the second end of each of the first conductors penetrates out of the through hole into the accommodation groove, and the second end of each of the second conductors penetrates out of the through hole into the accommodation groove and is in power connection with the second end of the first conductor adapted to the second conductor.

9. The rotary steering drilling apparatus according to claim 7, wherein second ends of a part of the first conductors are in power connection to second ends of the second conductors adapted to the first conductors respectively via changeover switches.

10. The rotary steering drilling apparatus according to claim 1, wherein a first annular accommodation groove for accommodating the first electrical connecting assembly is arranged on one end of at least part of the cylinders, and a second annular accommodation groove for accommodating the second electrical connecting assembly is arranged on the other end of the cylinder, the first electrical connecting ring is adaptively connected to the first annular accommodation groove and is insulated from the cylinder, and the second electrical connecting ring is adaptively connected to the second annular accommodation groove and is insulated from the cylinder; and the adjacent cylinders are connected by a rotary buckle, such that the first electrical connecting assembly and the second electrical connecting assembly abut against each other; and the cylinder is made of a conducting material, and the adjacent cylinders can be conductive.

11. The rotary steering drilling apparatus according to claim 2, wherein at least two communication channels for enabling the first electrical connecting ring to communicate with the second electrical connecting ring are arranged in a side wall of each cylinder, the first electrical connecting ring further comprises first conductors, each of the first conducting regions on the first electrical connecting ring is in power connection to a first end of one of the first conductors, the second electrical connecting ring further comprises second conductors, and each of the second conducting regions on the second electrical connecting ring is in power connection to a first end of one of the second conductors; and a second end of each of the first conductors and a second end of each of the second conductors respectively penetrate into the communication channels at set positions and are in power connection, and the first conductor and the second conductor are insulated from the side wall of the cylinder.

12. The rotary steering drilling apparatus according to claim 3, wherein at least two communication channels for enabling the first electrical connecting ring to communicate with the second electrical connecting ring are arranged in a side wall of each cylinder, the first electrical connecting ring further comprises first conductors, each of the first conducting regions on the first electrical connecting ring is in power connection to a first end of one of the first conductors, the second electrical connecting ring further comprises second conductors, and each of the second conducting regions on the second electrical connecting ring is in power connection to a first end of one of the second conductors; and a second end of each of the first conductors and a second end of each of the second conductors respectively penetrate into the communication channels at set positions and are in power connection, and the first conductor and the second conductor are insulated from the side wall of the cylinder.

13. The rotary steering drilling apparatus according to claim 4, wherein at least two communication channels for enabling the first electrical connecting ring to communicate with the second electrical connecting ring are arranged in a side wall of each cylinder, the first electrical connecting ring further comprises first conductors, each of the first conducting regions on the first electrical connecting ring is in power connection to a first end of one of the first conductors, the second electrical connecting ring further comprises second conductors, and each of the second conducting regions on the second electrical connecting ring is in power connection to a first end of one of the second conductors; and a second end of each of the first conductors and a second end of each of the second conductors respectively penetrate into the communication channels at set positions and are in power connection, and the first conductor and the second conductor are insulated from the side wall of the cylinder.

14. The rotary steering drilling apparatus according to claim 5, wherein at least two communication channels for enabling the first electrical connecting ring to communicate with the second electrical connecting ring are arranged in a side wall of each cylinder, the first electrical connecting ring further comprises first conductors, each of the first conducting regions on the first electrical connecting ring is in power connection to a first end of one of the first conductors, the second electrical connecting ring further comprises second conductors, and each of the second conducting regions on the second electrical connecting ring is in power connection to a first end of one of the second conductors; and a second end of each of the first conductors and a second end of each of the second conductors respectively penetrate into the communication channels at set positions and are in power connection, and the first conductor and the second conductor are insulated from the side wall of the cylinder.

15. The rotary steering drilling apparatus according to claim 6, wherein at least two communication channels for enabling the first electrical connecting ring to communicate with the second electrical connecting ring are arranged in a side wall of each cylinder, the first electrical connecting ring further comprises first conductors, each of the first conducting regions on the first electrical connecting ring is in power connection to a first end of one of the first conductors, the second electrical connecting ring further comprises second conductors, and each of the second conducting regions on the second electrical connecting ring is in power connection to a first end of one of the second conductors; and a second end of each of the first conductors and a second end of each of the second conductors respectively penetrate into the communication channels at set positions and are in power connection, and the first conductor and the second conductor are insulated from the side wall of the cylinder.

16. The rotary steering drilling apparatus according to claim 2, wherein a first annular accommodation groove for accommodating the first electrical connecting assembly is arranged on one end of at least part of the cylinders, and a second annular accommodation groove for accommodating the second electrical connecting assembly is arranged on the other end of the cylinder, the first electrical connecting ring is adaptively connected to the first annular accommodation groove and is insulated from the cylinder, and the second electrical connecting ring is adaptively connected to the second annular accommodation groove and is insulated from the cylinder; and the adjacent cylinders are connected by a rotary buckle, such that the first electrical connecting assembly and the second electrical connecting assembly abut against each other; and the cylinder is made of a conducting material, and the adjacent cylinders can be conductive.

17. The rotary steering drilling apparatus according to claim 3, wherein a first annular accommodation groove for accommodating the first electrical connecting assembly is arranged on one end of at least part of the cylinders, and a second annular accommodation groove for accommodating the second electrical connecting assembly is arranged on the other end of the cylinder, the first electrical connecting ring is adaptively connected to the first annular accommodation groove and is insulated from the cylinder, and the second electrical connecting ring is adaptively connected to the second annular accommodation groove and is insulated from the cylinder; and the adjacent cylinders are connected by a rotary buckle, such that the first electrical connecting assembly and the second electrical connecting assembly abut against each other; and the cylinder is made of a conducting material, and the adjacent cylinders can be conductive.

18. The rotary steering drilling apparatus according to claim 4, wherein a first annular accommodation groove for accommodating the first electrical connecting assembly is arranged on one end of at least part of the cylinders, and a second annular accommodation groove for accommodating the second electrical connecting assembly is arranged on the other end of the cylinder, the first electrical connecting ring is adaptively connected to the first annular accommodation groove and is insulated from the cylinder, and the second electrical connecting ring is adaptively connected to the second annular accommodation groove and is insulated from the cylinder; and the adjacent cylinders are connected by a rotary buckle, such that the first electrical connecting assembly and the second electrical connecting assembly abut against each other; and the cylinder is made of a conducting material, and the adjacent cylinders can be conductive.

19. The rotary steering drilling apparatus according to claim 5, wherein a first annular accommodation groove for accommodating the first electrical connecting assembly is arranged on one end of at least part of the cylinders, and a second annular accommodation groove for accommodating the second electrical connecting assembly is arranged on the other end of the cylinder, the first electrical connecting ring is adaptively connected to the first annular accommodation groove and is insulated from the cylinder, and the second electrical connecting ring is adaptively connected to the second annular accommodation groove and is insulated from the cylinder; and the adjacent cylinders are connected by a rotary buckle, such that the first electrical connecting assembly and the second electrical connecting assembly abut against each other; and the cylinder is made of a conducting material, and the adjacent cylinders can be conductive.

20. The rotary steering drilling apparatus according to claim 6, wherein a first annular accommodation groove for accommodating the first electrical connecting assembly is arranged on one end of at least part of the cylinders, and a second annular accommodation groove for accommodating the second electrical connecting assembly is arranged on the other end of the cylinder, the first electrical connecting ring is adaptively connected to the first annular accommodation groove and is insulated from the cylinder, and the second electrical connecting ring is adaptively connected to the second annular accommodation groove and is insulated from the cylinder; and the adjacent cylinders are connected by a rotary buckle, such that the first electrical connecting assembly and the second electrical connecting assembly abut against each other; and the cylinder is made of a conducting material, and the adjacent cylinders can be conductive.

* * * * *